US009349563B2

(12) United States Patent
Kosugi et al.

(10) Patent No.: US 9,349,563 B2
(45) Date of Patent: May 24, 2016

(54) X-RAY RADIATION SOURCE

(71) Applicant: HAMAMATSU PHOTONICS K.K., Hamamatsu-shi, Shizuoka (JP)

(72) Inventors: Norimasa Kosugi, Hamamatsu (JP); Naoki Okumura, Hamamatsu (JP); Tatsuya Nakamura, Hamamatsu (JP); Toru Fujita, Hamamatsu (JP); Tomoyuki Okada, Hamamatsu (JP); Akiomi Ujima, Hamamatsu (JP)

(73) Assignee: HAMAMATSU PHOTONICS K.K., Hamamatsu-shi, Shizuoka (JP)

( * ) Notice: Subject to any disclaimer, the term of this patent is extended or adjusted under 35 U.S.C. 154(b) by 74 days.

(21) Appl. No.: 14/380,988

(22) PCT Filed: Feb. 7, 2013

(86) PCT No.: PCT/JP2013/052898

§ 371 (c)(1),
(2) Date: Aug. 26, 2014

(87) PCT Pub. No.: WO2013/129068

PCT Pub. Date: Sep. 6, 2013

(65) Prior Publication Data

US 2015/0063548 A1 Mar. 5, 2015

(30) Foreign Application Priority Data

Mar. 2, 2012 (JP) ..... 2012-046840

(51) Int. Cl.
*H01J 5/18* (2006.01)
*H01J 35/02* (2006.01)
(Continued)

(52) U.S. Cl.
CPC ..... *H01J 35/025* (2013.01); *H01J 35/045* (2013.01); *H01J 35/18* (2013.01); *H05G 1/06* (2013.01); *H05G 1/70* (2013.01); *H01J 2235/02* (2013.01); *H01J 2235/186* (2013.01)

(58) Field of Classification Search
CPC ..... H01J 35/025; H01J 35/18; H01J 35/045; H01J 2235/02; H01J 2235/186; H05G 1/70; H05G 1/06
USPC ..... 378/119–140
See application file for complete search history.

(56) References Cited

U.S. PATENT DOCUMENTS 4,007,376 A 2/1977 Zimmerman
4,034,251 A 7/1977 Haas
(Continued)

FOREIGN PATENT DOCUMENTS

CN 1994029 7/2007
CN 101083867 12/2007
(Continued)

OTHER PUBLICATIONS

English-language translation of International Preliminary Report on Patentability (IPRP) dated Sep. 12, 2014 that issued in WO Patent Application No. PCT/JP2013/052898.

*Primary Examiner* — Courtney Thomas
(74) *Attorney, Agent, or Firm* — Drinker Biddle & Reath LLP

(57) ABSTRACT

In an X-ray radiation source, a lid part is fastened to a main part with screws, so that an X-ray tube is secured to a housing while being pressed against an inner surface of the wall part a by a first circuit board. The X-ray tube can be secured stably within the housing by thus being held between the first circuit board and the wall part. The X-ray radiation source uses the first circuit board incorporated in the housing itself for pressing the X-ray tube. This makes it unnecessary to provide new members for pressing the X-ray tube and can prevent the device structure from becoming complicated.

7 Claims, 13 Drawing Sheets

(a)

(b)

(51) Int. Cl.

| | |
|---|---|
| ***H05G 1/70*** | (2006.01) |
| ***H01J 35/18*** | (2006.01) |
| ***H01J 35/04*** | (2006.01) |
| ***H05G 1/06*** | (2006.01) |

(56) References Cited

U.S. PATENT DOCUMENTS 5,949,849 A 9/1999 Hirano et al.
8,675,817 B2 * 3/2014 Ogata ..... H01J 35/045 378/101
8,903,047 B1 * 12/2014 Wang ..... H05G 1/10 378/101

FOREIGN PATENT DOCUMENTS

| | | | |
|---|---|---|---|
| JP | H3-076399 | U | 7/1991 |
| JP | 2000-067790 | A | 3/2000 |
| JP | 2001-351797 | A | 12/2001 |
| JP | 2002-175899 | | 6/2002 |
| JP | 2006-338965 | A | 12/2006 |
| JP | 2007-005319 | A | 1/2007 |
| JP | 2007-066655 | A | 3/2007 |

* cited by examiner (a)

(b)

(a)

(b)

X-RAY RADIATION SOURCE

TECHNICAL FIELD

The present invention relates to an X-ray radiation source having an X-ray tube within a housing.

BACKGROUND ART

An example of conventional X-ray radiation sources is one disclosed in Patent Literature 1. In this conventional structure, an X-ray tube, a high voltage generation module, and the like are incorporated into a housing having an X-ray emission window, while the X-ray tube is brought into contact with and secured to a mount disposed near the X-ray emission window. In an X-ray generator disclosed in Patent Literature 2, on the other hand, a flange provided about an output window in an X-ray tube is brought into contact with and secured to an inner wall surface of a housing.

CITATION LIST

Patent Literature

Patent Literature 1: U.S. Pat. No. 4,034,251

Patent Literature 2: Japanese Patent Application Laid-Open No. 2000-67790

SUMMARY OF INVENTION

Technical Problem

From the viewpoint of stabilizing outputs of X-rays, it is very important to secure an X-ray tube stably within a housing. However, the X-ray tube is hard to secure stably by substantially fixing only one end side thereof as in Patent Literature 1. On the other hand, fixing at a plurality of locations as in Patent Literature 2 can stabilize the securing, but may complicate the structure due to a plurality of fixing members.

For solving the problem mentioned above, it is an object of the present invention to provide an X-ray radiation source which can stably secure an X-ray tube within a housing without complicating its device structure.

Solution to Problem

For achieving the above-mentioned object, the X-ray radiation source in accordance with the present invention is an X-ray radiation source comprising an X-ray tube for outputting an X-ray from an output window, a first circuit board for mounting the X-ray tube, and a housing containing the X-ray tube and first circuit board and having a wall part formed with an X-ray emission window for emitting to the outside the X-ray outputted from the X-ray tube, the X-ray tube being secured to the housing while being pressed against an inner surface of the wall part by the first circuit board.

In this X-ray radiation source, the X-ray tube is secured to the housing while being pressed against the inner surface of the wall part by the first circuit board. The X-ray tube can be secured stably within the housing by being held between the first circuit board and the wall part. In this X-ray radiation source, the first circuit board incorporated into the housing itself is used for pressing the X-ray tube. This makes it unnecessary to provide a separate member for pressing the X-ray tube and prevents the device structure from becoming complicated.

Preferably, a conductive buffer member is arranged between the X-ray tube and the inner surface of the wall part so as to come into contact with at least a part of the output window. This can stably secure the X-ray tube within the housing while mitigating stresses applied to the X-ray tube by the pressing. Since the buffer member is conductive, the housing and output window can have the same potential, thereby allowing the X-ray tube to operate stably.

Preferably, the housing has a main part having the wall part and a lid part for securing thereto the X-ray tube and first circuit board, the lid part being fastened to the main part by a fastening member so as to press the X-ray tube against the inner surface of the wall part. This can stably secure the X-ray tube in a simple structure.

Preferably, the X-ray tube and first circuit board are supported by a spacer member erected on the lid part. This allows the spacer member to press the X-ray tube securely against the inner surface of the wall part, while securing a fixed accommodation space within the housing, thereby making it possible to improve the degree of freedom in arranging circuit constituent members.

Preferably, the X-ray radiation source further comprises a high voltage generation module for raising a voltage supplied to the first circuit board and a second circuit board for mounting the high voltage generation module, the high voltage generation module and second circuit board being supported at a position closer to the lid part than are the X-ray tube and first circuit board by the spacer erected on the lid part. In this case, not only the X-ray tube, but the high pressure generation module having a relatively large structure is also contained in the accommodation space, whereby the space within the housing can be utilized effectively.

Preferably, the X-ray tube is provided with a laterally-projecting power pin, the first circuit board is provided with a through hole corresponding to a two-dimensional form of the X-ray tube, and the power pin is connected to an edge part about the through hole while a part of the X-ray tube is located within the through hole, so that the X-ray tube is held by the first circuit board. This makes it easy to align the X-ray tube and the first circuit board with each other. Since a part of the X-ray tube is located within the through hole, the housing can be made thinner by the depth of the through hole.

Preferably, the X-ray tube is provided with a laterally-projecting power pin, the first circuit board is provided with a depression corresponding to a two-dimensional form of the X-ray tube, and the power pin is connected to an edge part about the depression while a part of the X-ray tube is located within the depression, so that the X-ray tube is held by the first circuit hoard. This makes it easy to align the X-ray tube and the first circuit board with each other. This also allows the first circuit board to press the X-ray tube firmly. Since a part of the X-ray tube is located within the depression, the housing can be made thinner by the depth of the depression.

Advantageous Effects of Invention

The present invention can stably secure the X-ray tube within the housing without complicating the device structure.

DESCRIPTION OF EMBODIMENTS

Figure 1:
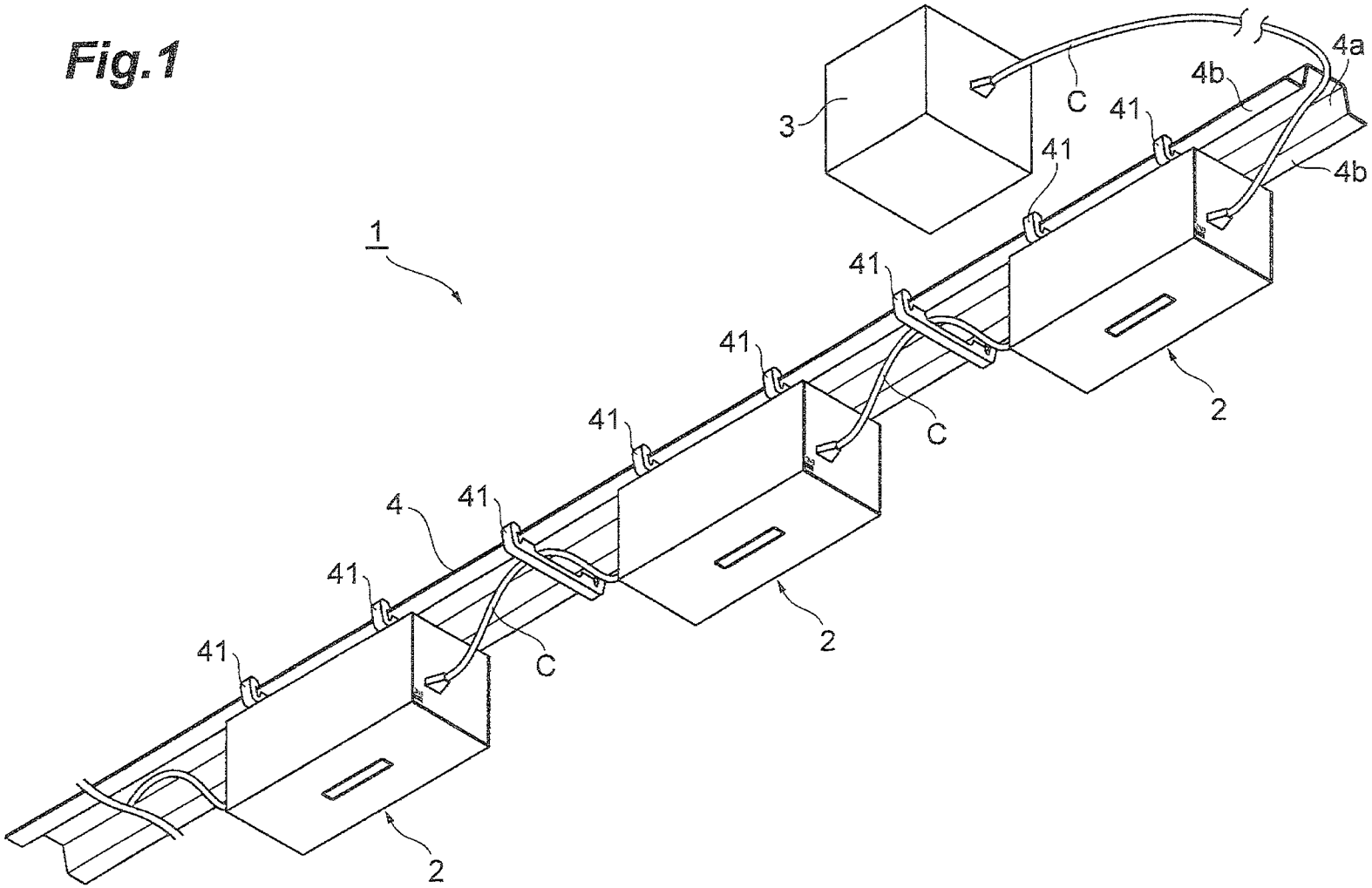
FIG. 1 is a perspective view illustrating an embodiment of an X-ray radiation device including an X-ray radiation source in accordance with the present invention.

In the following, preferred embodiments of the X-ray radiation source in accordance with the present invention will be explained in detail with reference to the drawings. FIG. 1 is a perspective view illustrating an embodiment of the X-ray radiation device including an X-ray radiation source in accordance with the present invention. The depicted X-ray radiation device 1 is constructed, for example, as a photoionizer (photoirradiation-type electrostatic remover) which is placed in a clean room or the like in a production line handling a large glass sheet and removes electricity of the large glass sheet by irradiation with X-rays.

The X-ray radiation device 1 comprises a plurality of X-ray radiation sources 2 for emitting X-rays, a controller 3 for controlling the X-ray radiation sources 2, and a rail member 4 for holding the X-ray radiation sources 2 in a row. The rail member 4 has a channel part 4*a* having a substantially U-shaped cross section formed with a depression directed away from the X-ray radiation sources 2 and flange parts 4*b*, 4*b* projecting laterally from the end portion of the channel part 4*a*. The rail member 4 is formed from a conductive metal such as aluminum, aluminum alloy, iron, or iron alloy, for example, and secures a strength sufficient for holding the plurality of X-ray radiation sources 2. The rail member 4 is not required to be formed integrally, but may be one detachably connecting separate members which are separated from each other along their longitudinal direction (extending direction). This can yield a holding structure with a desirable form and size according to the size, number, arrangement, and the like of objects to be processed, thereby making it possible to remove electricity by more efficient X-ray radiation.

Figure 2:
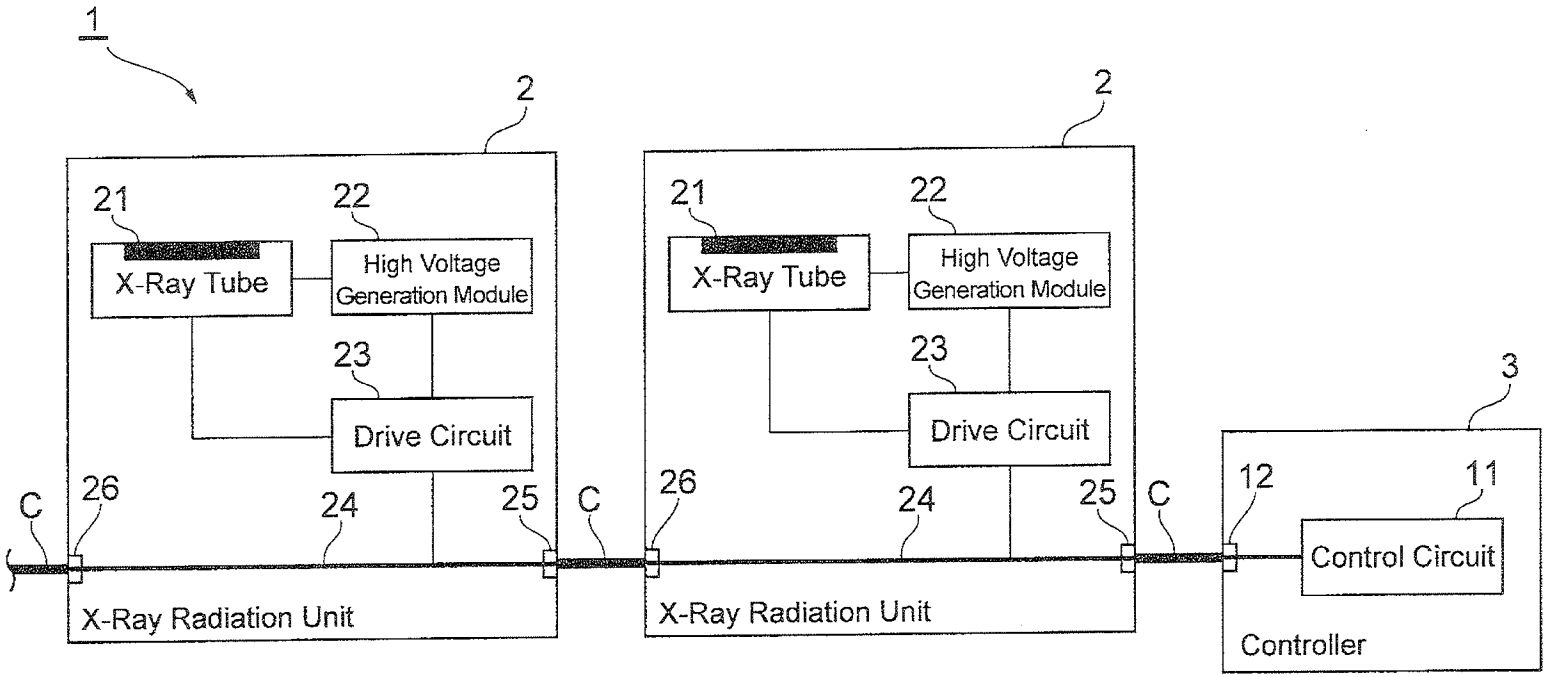
FIG. 2 is a block diagram illustrating functional constituents of the X-ray radiation device depicted in FIG. 1.

FIG. 2 is a block diagram illustrating functional constituents of the X-ray radiation device 1. As illustrated in this diagram, a controller 3 includes a control circuit 11. The control circuit 11 includes a power circuit for supplying power to X-ray tubes 21 incorporated in the X-ray radiation sources 2, a control signal transmission circuit for transmitting control signals to the X-ray tubes 21 for driving and stopping them, and a life notification signal receiving circuit for receiving from the X-ray tubes 21 a life notification signal indicating that the X-ray tubes 21 have come to the end of their life, for example. Through an I/O terminal 12, the control circuit 11 can externally be connected to the X-ray radiation units 2 and the like.

On the other hand, each X-ray radiation source 2 includes the X-ray tube 21 for generating X-rays, a high voltage generation module 22 for raising a voltage supplied from the power circuit, and a drive circuit 23 for driving the X-ray tube 21 and high voltage generation module 22. A trunk line 24 is connected to the drive circuit 23 and can externally be connected to the other X-ray radiation units 2, the controller 3, and the like through input and output terminals 25, 26 respectively provided at both ends thereof.

In the X-ray radiation device 1, as illustrated in FIGS. 1 and 2, the output terminal 26 of one X-ray radiation source 2 is detachably connected to the input terminal 25 of another X-ray radiation source 2 adjacent thereto through a relay cable C. While the X-ray radiation sources 2 are similarly connected to each other up to the X-ray radiation unit 2 at the leading end, the I/O terminal 12 of the controller 3 is detachably connected to the input terminal 25 of the X-ray radiation unit 2 at the base end through the relay cable C. This connects the trunk lines 24 of the X-ray radiation sources 2 in series and the driving circuits 23 of the X-ray radiation sources 2 in parallel to the control circuit 11.

This structure makes the voltage value inputted from the input terminal 25 equal to the voltage outputted from the output terminal 26 in one X-ray radiation source 2, and also makes the voltage value outputted from the output terminal 26 of one X-ray radiation unit 2 equal to each of the voltage value inputted from the input terminal 25 and the voltage value outputted from the output terminal 26 in another X-ray radiation unit 2 electrically connected to the former X-ray radiation unit 2. Therefore, even when a plurality of X-ray radiation source units 2 are connected in series, the same value of voltage can be supplied to all the X-ray radiation source units 2. Hence, when the X-ray radiation source units 2 are electrically connected to each other, the control circuit 11 of the controller 3 including the power circuit is not required to be connected to the X-ray radiation units 2 individually, whereby the number of X-ray radiation units 2 to be connected can be increased and decreased without complicating their wiring.

The structure of the above-mentioned X-ray radiation source 2 will now be explained in detail.

Figure 3:
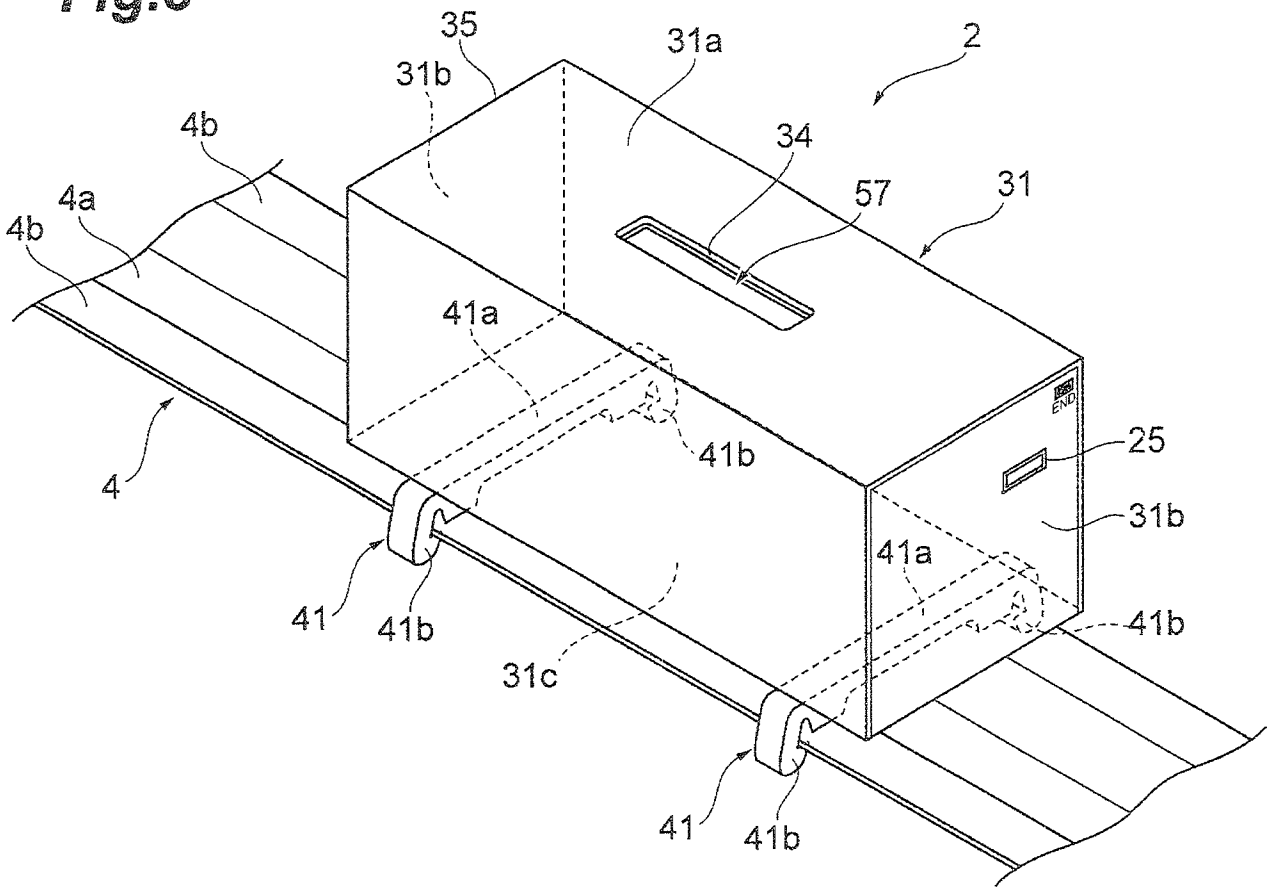
FIG. 3 is a perspective view of the X-ray radiation source illustrated in FIG. 1.
Figure 4:
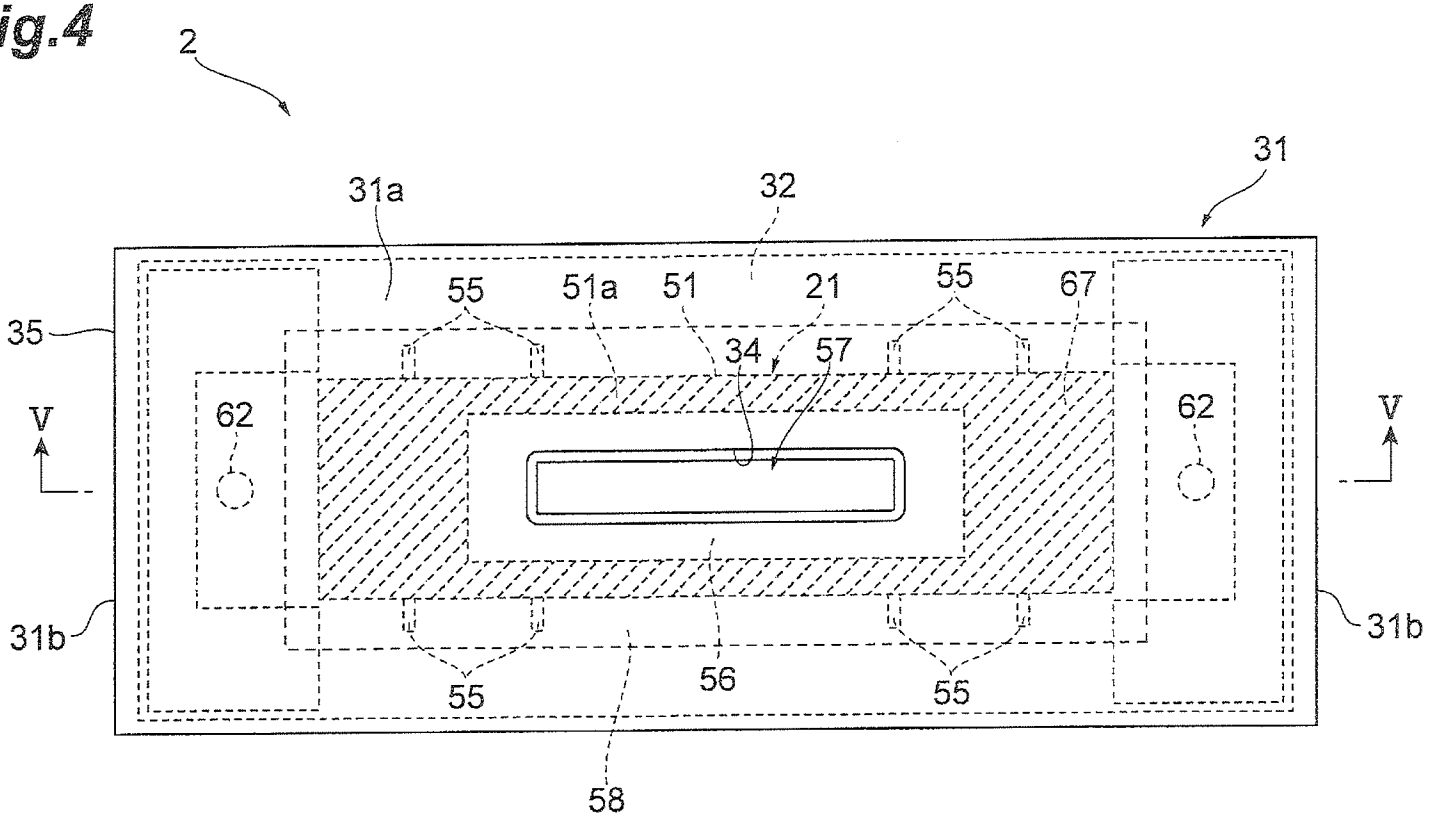
FIG. 4 is a plan view of FIG. 3.
Figure 5:
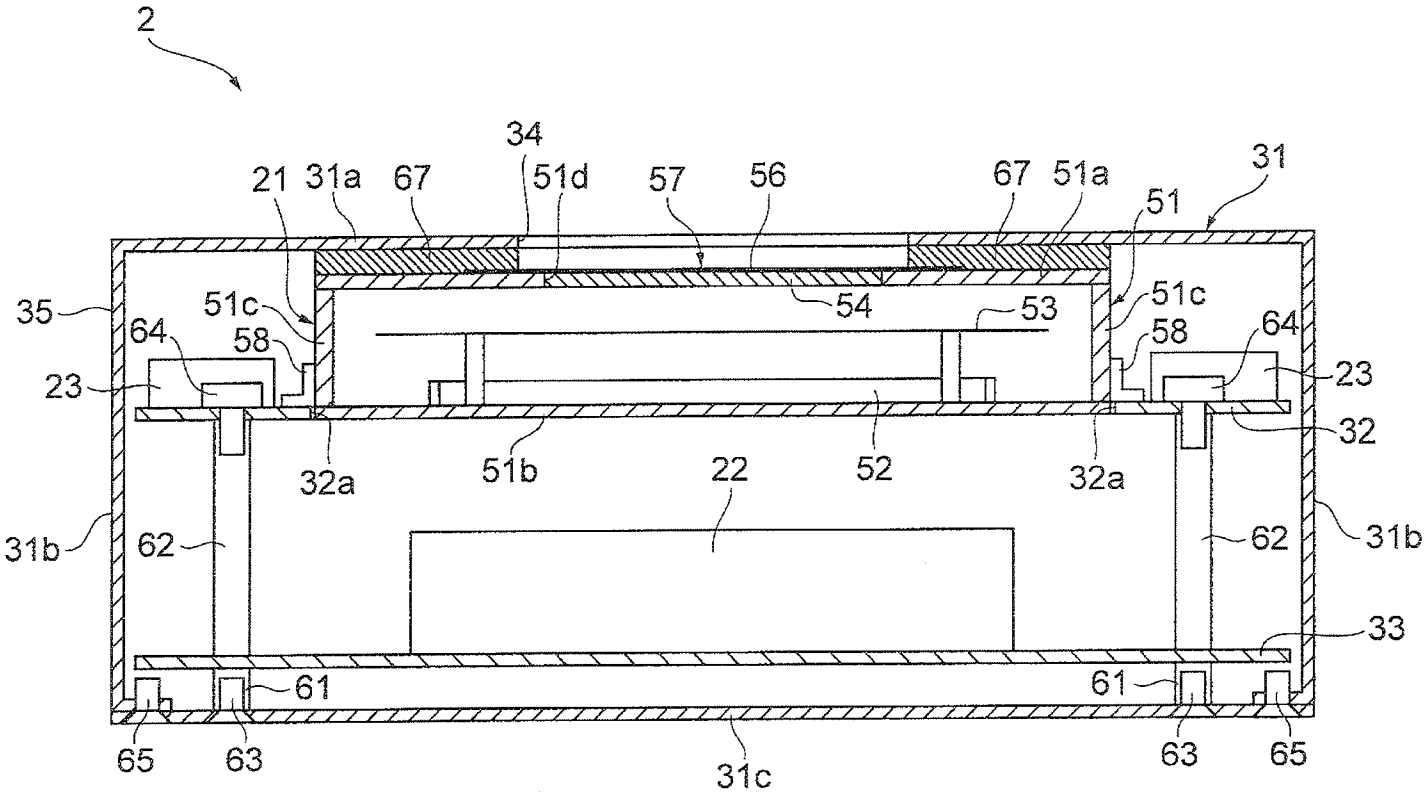
FIG. 5 is a sectional view taken along the line V-V of FIG. 4.

FIG. 3 is a perspective view of the X-ray radiation source illustrated in FIG. 1. FIG. 4 is a plan view of FIG. 3, while FIG. 5 is a sectional view taken along the line V-V of FIG. 4. As illustrated in FIGS. 3 to 5, the X-ray radiation source 2 has, within a substantially rectangular parallelepiped housing 31 made of a metal such as stainless steel or aluminum, the above-mentioned X-ray tube 21 and high voltage generation module 22, a first circuit board 32 mounting at least a part of the X-ray tube 21 and drive circuit 23, and a second circuit board 33 mounting the high voltage generation module 22.

As illustrated in FIG. 3, the housing 31 comprises a rectangular wall part 31 formed with an X-ray emission window 34 for emitting to the outside the X-rays generated from the X-ray tube 21, a main part 35 having side wall parts 31*b* provided at respective sides of the wall part 31*a* and opening on one surface side, and a lid part 31*c* attached so as to close the opening portion of the main part 35 and is at a ground potential. The X-ray emission window 34 is constructed by an opening which is formed into a rectangle, whose longer sides extend longitudinally of the housing 31, at a substantially center portion of the wall part 31*a*.

As illustrated in FIG. 3, a plurality of joint members 41 are used for attaching the housing 31 to the rail member 4. For example, each joint member 41 is formed from an insulating elastic resin material and comprises a rod-shaped main part 41*a* having a rectangular cross section and a length substantially equal to the width of the rail member 4 (in a direction orthogonal to the extending direction of the rail member 4) and claws 41*b*, 41*b* respectively formed at both ends of the main part 41*a*. The main part 41*a* is secured to the lid part 31*c* by screwing or the like, and the claws 41*b*, 41*b* are engaged with respective end portions of the flange parts 4*b*, 4*b*, whereby the X-ray radiation source 2 is detachably attached to the rail member 4. The main part 41*a* may be attached to the lid part 31*c* by not only screwing but also bonding or welding. As illustrated in FIG. 1, the joint member 41 may additionally be attached between the X-ray radiation sources 2, 2, so as to bind a middle part of the relay cable C, which connects the X-ray radiation sources 2, 2 to each other, to the rail member 4.

The X-ray tube 21 has, within a vacuum envelope 51 having a substantially rectangular parallelepiped form sufficiently smaller than the housing 31, a filament 52 for generating an electron beam, a grid 53 for accelerating the electron beam, and a target 54 for generating X-rays in response to the electron beam incident thereon. The vacuum envelope 51 comprises a rectangular wall part 51 made of a conductive material (e.g., a sheet of a metal such as stainless steel) provided with an output window 57 which will be explained later, a wall part 51*b*, made of a rectangular insulating material (e.g., glass), facing the former wall part 51*a*, and a side wall part 51*c*, made of an insulating material (e.g., glass), extending along the outer edges of the wall parts 51*a*, 51*b*. The height of the side wall part 51*c* is smaller than the lateral length of the wall parts 51*a*, 51*b*. That is, the vacuum envelope 51 has a planar, substantially rectangular parallelepiped form whose sides constituting the height are the shortest so that the wall parts 51*a*, 51*b* can be regarded as a flat plane. At a substantially center portion of the wall part 51*a*, an opening 51*d* a bit smaller than the X-ray emission window 34 is formed into a rectangle whose longer sides extend along the longitudinal direction of the vacuum envelope 51 (the longitudinal direction of the wall parts 51*a*, 51*b*). The opening 51*d* constitutes the output window 57 that will be explained later.

The filament 52 is arranged on the wall part 51*b* side, while the grid 53 is placed between the filament 52 and the target 54. A plurality of power pins 55 (see FIG. 4) are connected to each of the filament 52 and grid 53. The power pins 55 pass through the interstice between the side wall part 51*c* and the wall part 51*b* and project respectively to both sides in the width direction of the vacuum envelope 51. As illustrated in FIG. 5, a rectangular window material 56 made of a favorably radiolucent, conductive material such as beryllium, silicon, or titanium, for example, is closely secured to the outer surface side of the wall part 51*a* so as to seal the opening 51*d*, thereby constructing the output window 57 through which the X-rays generated at the target 54 is outputted from the X-ray tube 21 to the outside. The target 54, which is made of tungsten, for example, is formed on the inner surface of the window material 56.

Figure 6:
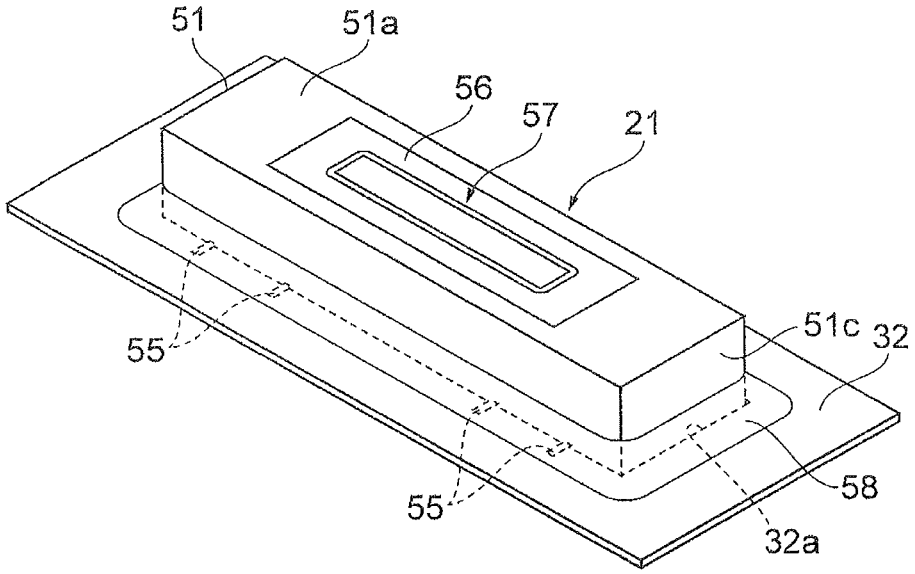
FIG. 6 is a set of diagrams illustrating an example of structures for securing the X-ray tube and the first circuit board to each other.
Figure 6:
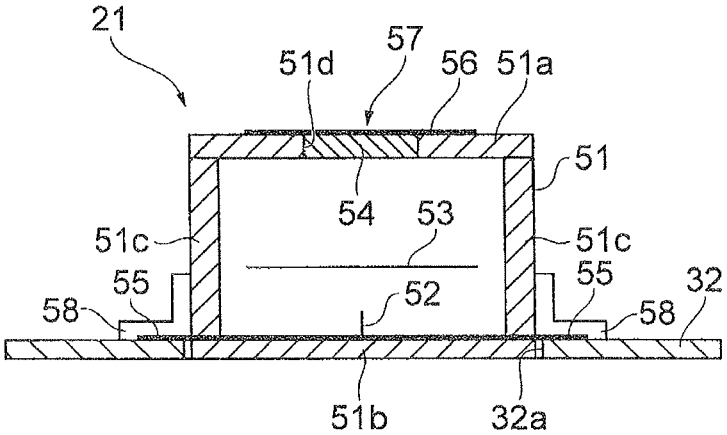

For securing the X-ray tube 21 and the first circuit board 32 to each other, as illustrated in FIGS. 6(*a*) and 6(*b*), a rectangular through hole 32*a* slightly larger than the two-dimensional form constructed by the outermost edges of the wall part 51*b* of the X-ray tube 21 is formed at a substantially center portion of the first circuit board 32. The depth of the through hole 32*a*, i.e., the thickness of the first circuit board 32, is substantially the same as the thickness of the wall part 51*b* in the vacuum envelope 51. Placing the wall part 51*b* within the through hole 32*a* while connecting the power pins 55 to an edge part about the through hole 32*a* on one surface side of the first circuit board 32 with a conductive member such as a brazing material allows the X-ray tube 21 to be held by the first circuit board 32 and electrically connected to the circuits on the first circuit board 32. Further, a potting part 58 formed from an insulating resin is provided so as to cover junctions between the first circuit board 32 and the individual power pins 55. The potting part 58 is formed over the whole periphery of the vacuum envelope 51 while bridging the vacuum envelope 51 and the first circuit board 32 and also assists in securing the X-ray tube 21 to the first circuit board 32. For securing the high voltage generation module 22 and the second circuit board 33 to each other, on the other hand, the second circuit board 33 is not formed with a through hole and the like, whereby the high voltage generation module 22 is secured by bonding and the like to one surface side of the second circuit board 33 facing the first circuit board 32 as illustrated in FIG. 5.

Figure 7:
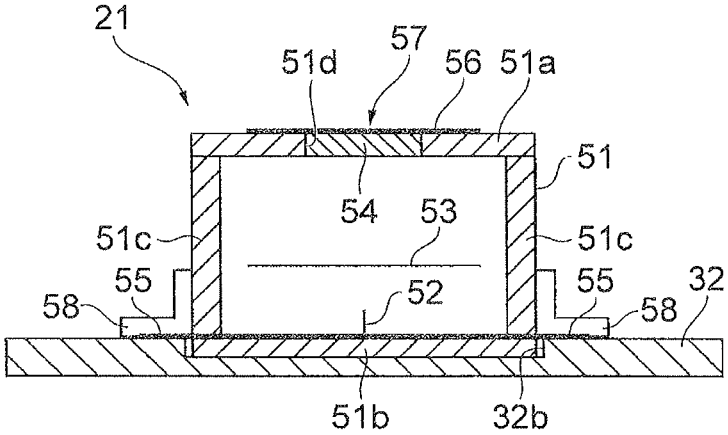
FIG. 7 is a set of diagrams illustrating other examples of structures for securing the X-ray tube and the first circuit board to each other.
Figure 7:
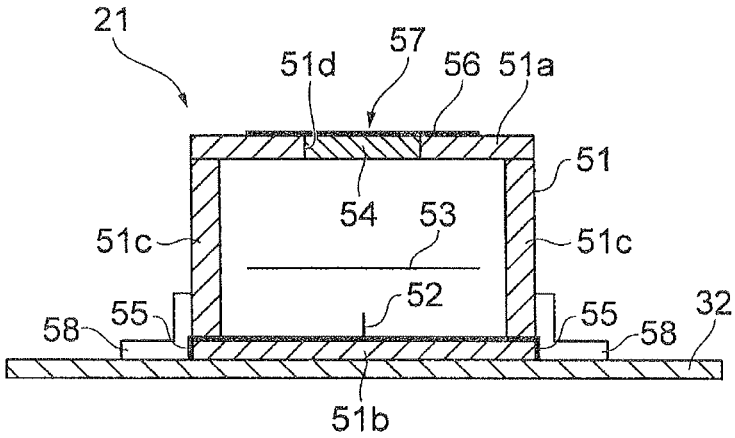

For securing the X-ray tube 21 and the first circuit board 32 to each other, when the first circuit board 32 has a sufficient thickness, a depression 32*b* slightly larger than the two-dimensional form constructed by the outermost edges of the wall part 51*b* of the X-ray tube 21 may be formed as illustrated in FIG. 7(*a*) instead of the above-mentioned through hole 32*a*. Preferably, in this case, the X-ray tube 21 is arranged such that the wall part 51*b* is located within the depression 32*b* while the power pins 55 are in contact with the edge part about the depression 32*b* on one surface side of the first circuit board 32.

It is not always necessary to form the through hole 32*a* or depression 32*b*, and the vacuum envelope 51 of the X-ray tube 21 may be mounted as it is on one surface side of the first circuit board 32 as illustrated in FIG. 7(*b*). In this case, for example, the power pins 55 may be extended along the side faces of the wall part 51*b*, so as to come into contact with the first circuit board 32. In any mode, the power pins 55 may be formed not only to project laterally of the vacuum envelope 51, but also to be routed to the side faces and bottom face of the wall part 51*b* or the outer surface of the side wall part 51*c*, for example, as long as they are electrically and physically in contact with the first circuit board 32.

As illustrated in FIGS. 4 and 5, a two-stage structure constructed by spacer members 61, 62 is employed for securing the X-ray tube 21, high voltage generation module 22, first circuit board 32, and second circuit board 33 within the housing 31. Each of the spacer members 61, 62 is formed into a rod from ceramics or various resin materials such as polyimide, nylon, and epoxy, for example, and is not conductive. Two pairs of the spacers 61, 62 are arranged at respective locations longitudinally holding the vacuum envelope 51 therebetween.

Each of the first-stage spacer members 61 is vertically mounted on the inner surface side of the lid part 31*c* by fastening a screw 63, and each of the second-stage spacer members 62 is joined to the leading end of the first-stage spacer member 61 while holding and securing the second circuit board 33 mounted with the high voltage generation module 22. The first circuit board 32 mounted with the X-ray tube 21 is secured substantially in parallel with the second circuit board 33 to the leading end of the second-stage spacer member 62 by fastening a screw 64.

The lid part 31*c* provided with such a structure is positioned such that the output window 57 of the X-ray tube 21 is exposed through the X-ray emission window 34 of the housing 31, while being secured to the main part 35 by fastening screws 65. Fastening the screws 65 causes the first circuit board 32 to press the X-ray tube 21 against the inner surface of the wall part 31*a* in the housing 31. The length of the second-stage spacer member 62 is on the order of several times that of the first-stage spacer member 61, so that the first circuit board 32 and the high voltage generation module 22 are separated from each other. The first circuit board 32 and high voltage generation module 22 may be connected to each other with a wire or wirelessly.

As illustrated in FIGS. 4 and 5, a buffer member 67, made of steel wool, conductive mat, or conductive rubber, for example, which is conductive and cushionable is arranged between the X-ray tube 21 and the wall part 31*a*. The buffer member 67 comprises an opening part for exposing the output window 57 and a rectangular frame part surrounding the output window 57 so as to come into contact with the peripheral part of the window material 56 and electrically connects the housing 31 and the output window 57 to each other. The X-ray emission window 34 formed in the housing 31 is a bit larger than the output window 57 of the X-ray tube 21, so as to expose the output window 57 as a whole when seen from above the housing 31 so as to face the wall part 31*a*. This can restrain the edge part of the X-ray emission window 34 from blocking the X-rays emitted with a divergent angle from the output window 57. All of the materials such as the window material 56, wall part 51*a*, and buffer member 67 that may be exposed through the X-ray emission window 34 are conductive and electrically connected to the housing 31.

In the X-ray radiation source 2, as explained in the foregoing, the lid part 31*c* is fastened to the main part 35 with the screws 65, whereby the X-ray tube 21 is secured to the housing 31 while being pressed against the inner surface of the wall part 31*a* by the first circuit board 32. The X-ray tube 21 can be secured stably within the housing 31 by thus being held between the first circuit board 32 and the wall part 31*a*. Since the X-ray tube 21 is secured while, among the surfaces constructing the vacuum envelope 51 of the X-ray tube 21, the one having a larger area on the wall part 51*a* side formed with the output window 57 is pressed against the inner surface of the wall part 31*a*, this embodiment can secure the X-ray tube 21 more stably, makes it easier for the heat generated at the target 54 to transfer to the housing 31, and is excellent in heat dissipation efficiency of the X-ray tube 21. This X-ray radiation source 2 uses the first circuit board 32 incorporated in the housing 31 itself for pressing the X-ray tube 21. That is, a structure essential for operating the X-ray radiation source 2 also serves as a member for pressing the X-ray tube 21, which makes it unnecessary to provide a new member for pressing the X-ray tube 21 separately, whereby the device structure can be prevented from becoming complicated.

In the X-ray radiation source 2, the conductive buffer member 67 is arranged between the X-ray tube 21 and the inner surface of the wall part 31*a* so as to come into contact with the sheet 56 constituting the output window 57. This enables stronger pressing while mitigating direct stresses applied to the X-ray tube 21 by the pressing, whereby the X-ray tube 21 can be secured more stably within the housing 31. Since the buffer member 67 is conductive, the housing 31 and the output window 57 can have the same potential, so as to stabilize the potential of the output window 57, thereby allowing the X-ray tube 21 to operate stably.

In the X-ray radiation source 2, the spacer members 61, 62 erected on the lid part 31*c* configure the first circuit board 32 mounted with the X-ray tube 21 and the second circuit board 33 mounted with the high voltage generation module 22 into a two-stage structure, so that the high voltage generation module 22 and second circuit board 33 are supported at a position closer to the lid part 31*c* than are the X-ray tube 21 and first circuit board 32. Such a structure allows the spacer members 61, 62 to secure a fixed accommodation space within the housing 31 and divide circuits arranged within the housing 31 into the first and second circuit boards 32, 33, whereby the degree of freedom in arranging circuit constituent members can be improved. In particular, the high voltage generation module 22, which is a relatively large structure on a par with the X-ray tube 21 in the X-ray radiation source 2, is contained in the accommodation space, whereby the space within the housing 31 can be utilized effectively.

In the X-ray radiation source 2, the power pins 55 laterally project from the vacuum envelope 51 of the X-ray tube 21, the first circuit board 32 is provided with the through hole 32*a* corresponding to the two-dimensional form of the X-ray tube 21, and the power pins 55 are connected to the edge part about the through hole 32*a* while the wall part 51*b* of the X-ray tube 21 is located within the through hole 32*a*, so that the first circuit board 32 holds the X-ray tube 21. This makes it easier to align the X-ray tube 21 and the first circuit board 32 with each other. Since the wall part 51*b* of the X-ray tube 21 is located within the through hole 32*a*, the thickness of the housing 31 can be reduced by the depth of the through hole 32*a*, whereby the device can be made smaller.

Forming the depression 32*b* instead of the through hole 32*a* as illustrated in FIG. 7(*a*) can also make it easier to align the X-ray tube 21 and the first circuit board 32 with each other by the depression 32*b* and bring the first circuit board 32 and the X-ray tube 21 directly into surface contact with each other, thereby firmly pressing the X-ray tube 21. Locating the wall part 51*b* of the X-ray tube 21 within the depression 32*b* can also reduce the thickness of the housing 31 by the depth of the depression 32*b*.

Mounting the vacuum envelope 51 of the X-ray tube 21 as it is on one surface side of the first circuit board 32 as illustrated in FIG. 7(*b*) can also bring the first circuit board 32 and the X-ray tube 21 directly into surface contact with each other, thereby firmly pressing the X-ray tube 21. Firmly pressing the X-ray tube 21 against the wall part 31*a* can improve the efficiency of heat transfer from the X-ray tube 21 to the housing 31, i.e., the heat dissipation efficiency of the X-ray tube 21.

The present invention is not limited to the above-mentioned embodiment. For example, while the above-mentioned embodiment uses the rod-shaped spacer members 61, 62, spacer members may have various forms such as pillars, plates, and frames. The number of spacer members and locations where they are arranged may also be designed as appropriate.

Figure 8:
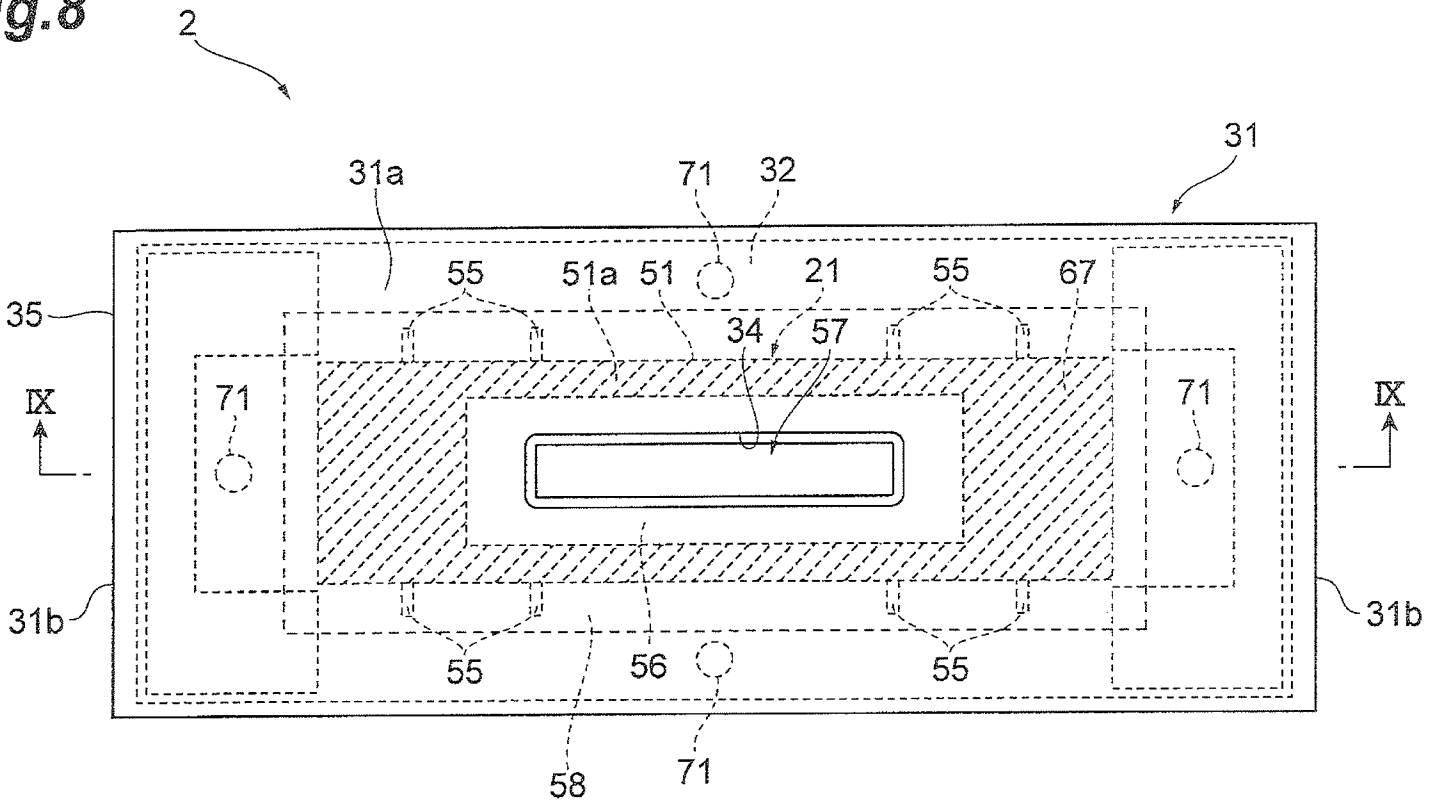
FIG. 8 is a plan view illustrating a modified example of the X-ray radiation source.
Figure 9:
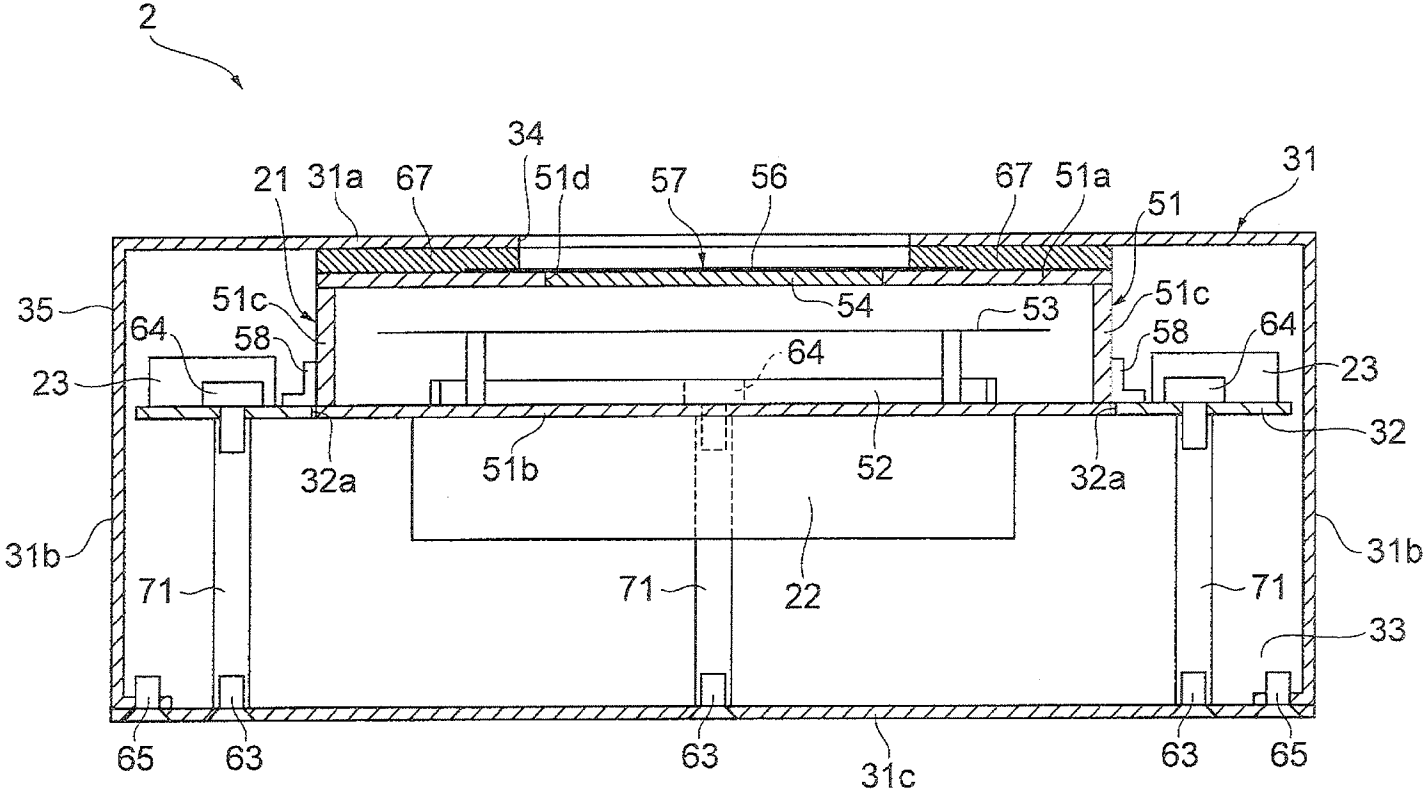
FIG. 9 is a sectional view taken along the line IX-IX of FIG. 8.

The structure for assembling the X-ray tube 21 and the like within the housing 31 may also be modified accordingly. For example, in an example illustrated in FIGS. 8 and 9, the first circuit board 32 is provided with a function of the second circuit board 33, so as to reduce the number of substrates, while spacer members 71 arranged at four locations on both sides in the longitudinal and lateral directions of the X-ray tube 21 support the first circuit board 32. Each spacer member 71 has a length substantially equal to the total length of the couple of spacer members 61, 62 illustrated in FIG. 5, thereby securing a space between the first circuit board 32 and the lid part 31*c*. The high voltage generation module 22 is secured to a surface of the first circuit board 32 on the side opposite from the X-ray tube 21.

Such a structure can make the housing 31 thinner by reducing the number of circuit boards. Supporting the first circuit board 32 with the spacer members 71 at four locations allows the first circuit board 32 to press the X-ray tube 21 uniformly, whereby the X-ray tube 21 can be secured more stably within the housing 31. The length of the spacer members 71 may be shorter than the total length of a pair of spacer members 61, 62 as long as a space necessary for arranging the high voltage generation module 22 can be formed thereby.

Figure 10:
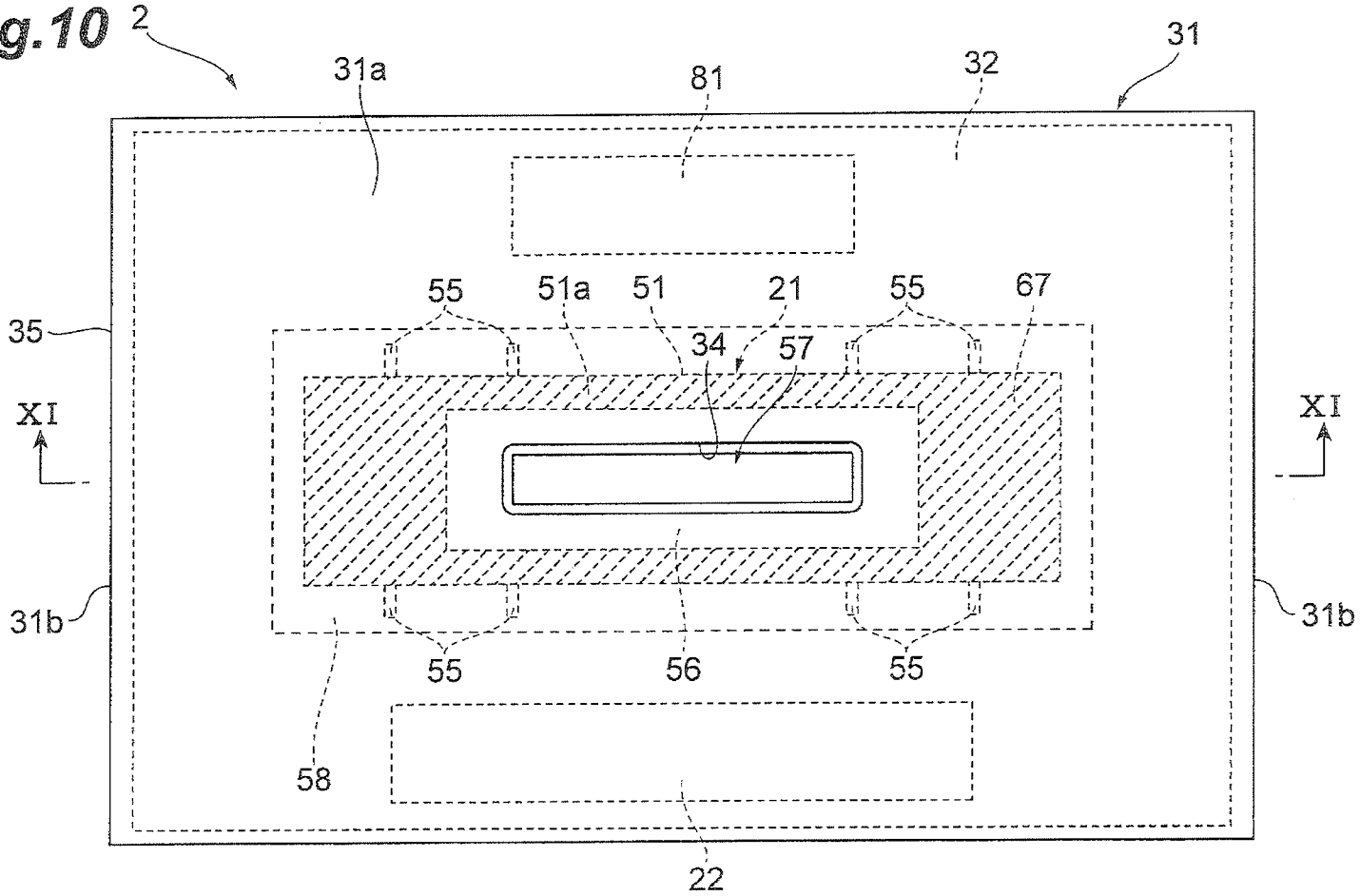
FIG. 10 is a plan view illustrating another modified example of the X-ray radiation source.
Figure 11:
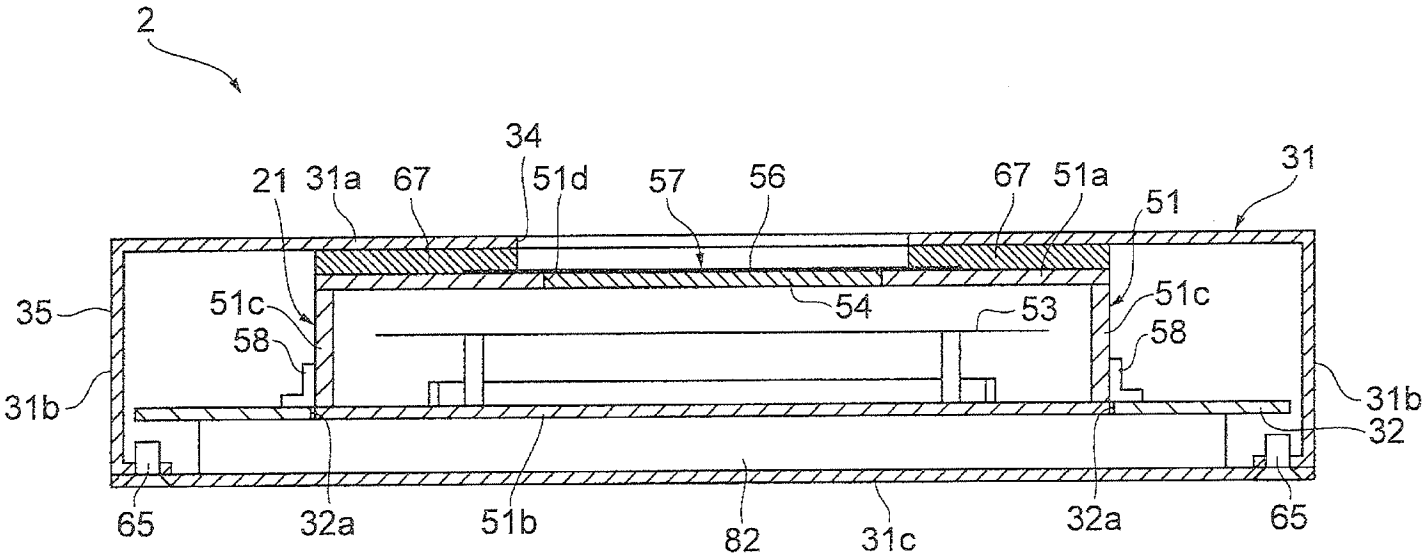
FIG. 11 is a sectional view taken along the line XI-XI of FIG. 10.

In an example illustrated in FIGS. 10 and 11, for instance, a housing 31 having an area larger than the first circuit board 32 illustrated in FIGS. 4 and 5 and the first circuit board 32 are used, an arrangement region 81 for the drive circuit 23 for driving the X-ray tube 21 is provided on one side in the width direction of the X-ray tube 21 on one surface side of the first circuit board 32, and the high voltage generation module 22 is mounted on the other side. A frame-shaped spacer member 82 is secured to the lid part 31*c*, while the first circuit board 32 is fixed to the leading end of the spacer member 82. Such a structure can make the housing 31 thinner by reducing the number of circuit boards. Supporting the first circuit board 32 with the frame-shaped spacer member 82 allows the first circuit board 32 to press the X-ray tube 21 uniformly, whereby the X-ray tube 21 can be secured more stably within the housing 31.

Figure 12:
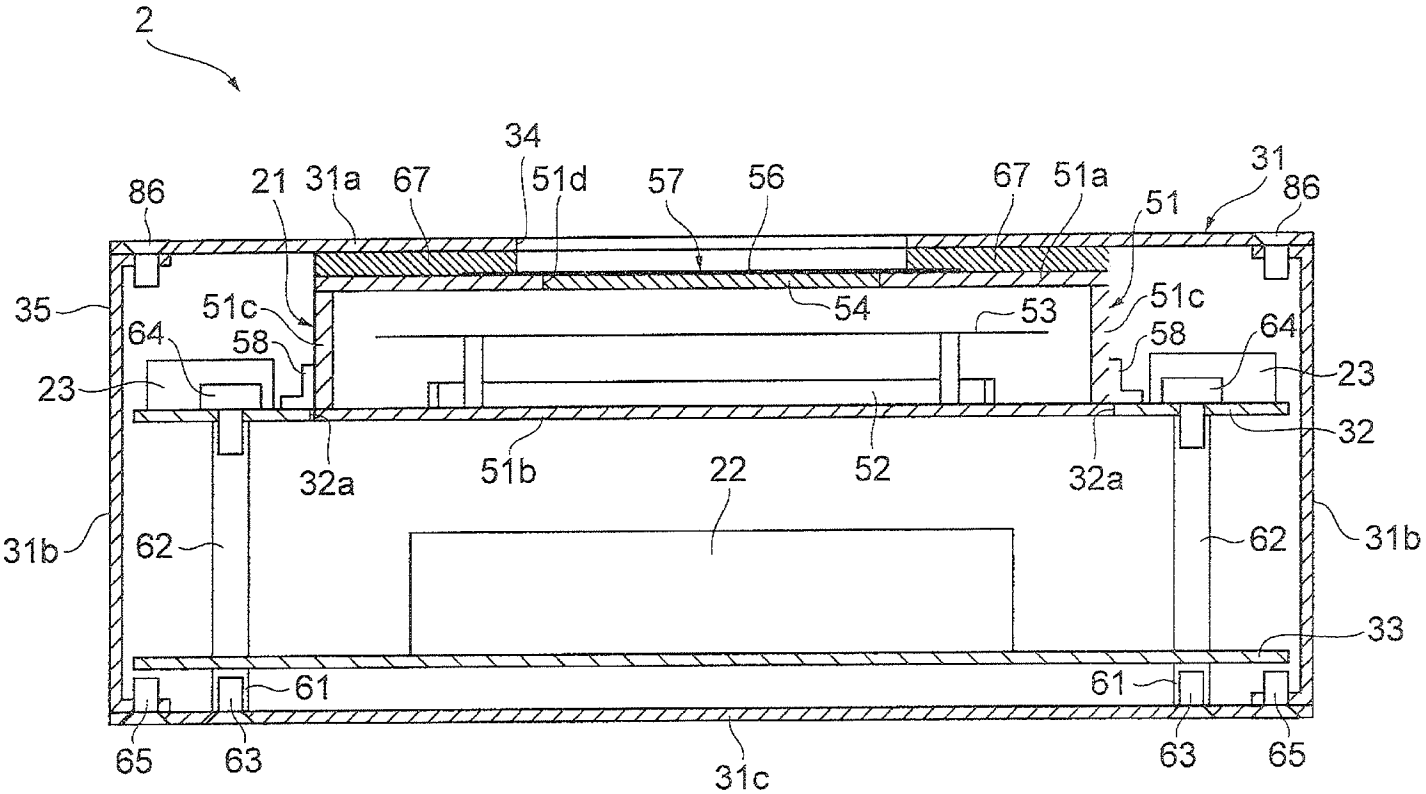
FIG. 12 is a sectional view illustrating still another modified example of the X-ray radiation source.

In an example illustrated in FIG. 12, for instance, an extension is provided along the inner surface of the wall part 31*a* in the side wall part 31*b* of the housing 31, and the extension and end portions of the wall part 31*a* are fastened with screws 86. As a consequence, the X-ray tube 21 is pressed not only against the inner surface of the wall part 31*a* by the first circuit board 32, but also against the first circuit board 32 by the inner surface of the wall part 31*a*. Therefore, the X-ray tube 21 is further firmly held between the first circuit board 32 and the inner surface of the wall part 31*a* and thus can be secured more stably within the housing 31.

Figure 13:
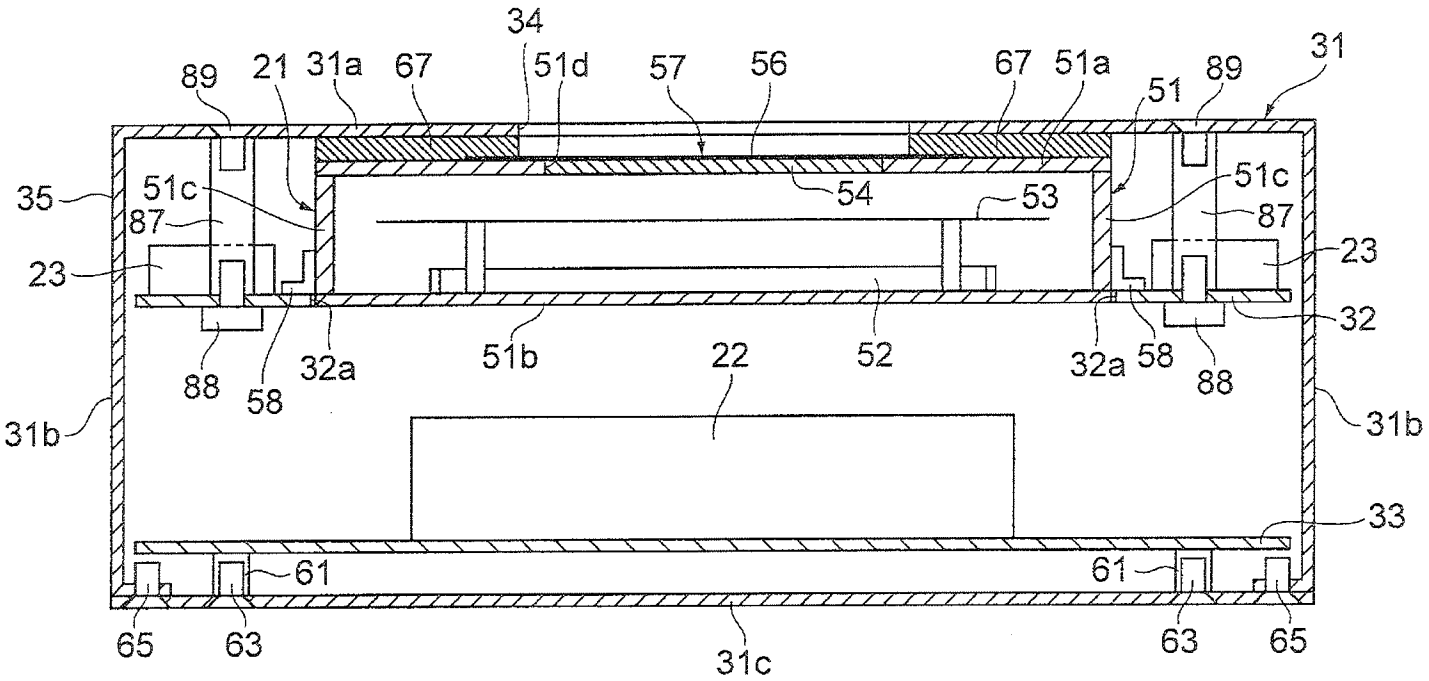
FIG. 13 is a sectional view illustrating yet another modified example of the X-ray radiation source.

In an example illustrated in FIG. 13, for instance, spacer members 87 are provided between the first circuit board 32 and the wall part 31*a* in place of the spacer members 62 arranged between the first and second circuit boards 32, 33. A screw 88 is fastened to one end part of each spacer member 87 through the first circuit board 32, while a screw 89 is fastened to the other end part of the spacer member 87 through the wall part 31*a*. In such a structure, the X-ray tube 21 is pressed not only against the inner surface of the wall part 31*a* by the first circuit board 32, but also against the first circuit board 32 by the inner surface of the wall part 31*a*. Therefore, the X-ray tube 21 is further firmly held between the first circuit board 32 and the inner surface of the wall part 31*a* and thus can be secured more stably within the housing 31.

It is not always necessary to use spacer members within the housing. In this case, for example, the lid part 31*c* itself may be provided with a projection projecting into the housing 31, so as to press the first circuit board 32. The side wall part 31*b* may also be provided with a projection adapted to act similarly.

REFERENCE SIGNS LIST

1: X-ray radiation device; 2: X-ray radiation source; 21: X-ray tube; 22: high voltage generation module; 31: housing; 31*a*: wall part; 31*c*: lid part; 32: first circuit board; 32*a*: through hole; 32*b*: depression; 33: second circuit board; 34: X-ray emission window; 35: main part; 55: power pin; 57: output window; 61, 62, 71, 82, 87: spacer member; 65, 86, 88, 89: screw (fastening member); 67: buffer member

The invention claimed is:

1. An X-ray radiation source comprising:

an X-ray tube for outputting an X-ray from an output window;

a first circuit board for mounting the X-ray tube; and a housing containing the X-ray tube and first circuit board and having a wall part formed with an X-ray emission window for emitting to the outside the X-ray outputted from the X-ray tube;

wherein the X-ray tube is secured to the housing while being pressed against an inner surface of the wall part by the first circuit board.

2. An X-ray radiation source according to claim 1, wherein a conductive buffer member is arranged between the X-ray tube and the inner surface of the wall part so as to come into contact with at least a part of the output window.

3. An X-ray radiation source according to claim 1, wherein the housing has a main part having the wall part and a lid part for securing thereto the X-ray tube and first circuit board;

wherein the lid part is fastened to the main part by a fastening member so as to press the X-ray tube against the inner surface of the wall part.

4. An X-ray radiation source according to claim 3, wherein the X-ray tube and first circuit board are supported by a spacer member erected on the lid part.

5. An X-ray radiation source according to claim 4, further comprising a high voltage generation module for raising a voltage supplied to the first circuit board and a second circuit board for mounting the high voltage generation module;

wherein the high voltage generation module and second circuit board are supported at a position closer to the lid part than are the X-ray tube and first circuit board by the spacer erected on the lid part.

6. An X-ray radiation source according to claim 1, wherein the X-ray tube is provided with a laterally-projecting power pin;

wherein the first circuit board is provided with a through hole corresponding to a two-dimensional form of the X-ray tube; and wherein the power pin is connected to an edge part about the through hole while a part of the X-ray tube is located within the through hole, so that the X-ray tube is held by the first circuit board.

7. An X-ray radiation source according to claim 1, wherein the X-ray tube is provided with a laterally-projecting power pin;

wherein the first circuit board is provided with a depression corresponding to a two-dimensional form of the X-ray tube; and wherein the power pin is connected to an edge part about the depression while a part of the X-ray tube is located within the depression, so that the X-ray tube is held by the first circuit board.

* * * * *